United States Patent [19]

Acheson

[11] Patent Number: 4,869,779

[45] Date of Patent: Sep. 26, 1989

[54] HYDROPLANE POLISHING DEVICE AND METHOD

[76] Inventor: Robert E. Acheson, 2 Canter Rd., Tyngsborough, Mass. 01879

[21] Appl. No.: 78,370

[22] Filed: Jul. 27, 1987

[51] Int. Cl.[4] ..... B24B 57/02; H01L 21/302

[52] U.S. Cl. ..... 156/636; 156/645; 156/662; 156/345; 51/131.3; 437/225; 437/946

[58] Field of Search ..... 156/636, 645, 662, 345; 51/131.1, 131.3, 131.5, 123 R; 415/203; 437/225, 946

[56] References Cited

U.S. PATENT DOCUMENTS

| | | | |
|---|---|---|---|
| 3,128,988 | 4/1964 | Mandroian | 415/203 |
| 3,549,439 | 12/1970 | Kaveggia et al. | 156/636 |
| 3,762,103 | 10/1973 | Nielsen | 51/123 R X |
| 3,841,031 | 10/1974 | Walsh | 51/283 |
| 3,842,544 | 10/1974 | Paola | 51/129 |
| 3,857,123 | 12/1974 | Walsh | 51/131 |
| 4,194,324 | 3/1980 | Bonora et al. | 51/131.5 |
| 4,244,775 | 1/1981 | D'Asaro | 156/636 |
| 4,256,535 | 3/1981 | Banks | 156/645 |
| 4,323,422 | 4/1982 | Calawa et al. | 156/636 |
| 4,373,991 | 2/1983 | Banks | 156/645 |
| 4,600,469 | 7/1986 | Fusco et al. | 156/636 |
| 4,612,733 | 9/1986 | Lee | 51/119 |

FOREIGN PATENT DOCUMENTS 945933 1/1964 United Kingdom .

OTHER PUBLICATIONS

Gormley et al., *Rev. Sci. Instrum.,* "Hydroplane Polishing of Semiconductor Crystals", vol. 52, pp. 1256–1258 (4/22/81).

Rideout, *Journal,* "An Improved Polishing Technique for GaAs", (7/6/72).

Vora et al., "Surface Finishing Using Soft Abrasives", pp. 262–267.

Myers et al., "Growth of Low Dislocation Density CdTe Films on Hydroplaned CdTe Substrates by Molecular Beam Epitaxy", pp. 1598–1603 (5/20/83).

Hyama et al., Review of the Electrical Comm. Lab., "A Prototype Discal Chemical Polishing Machine for GaAs", vol. 17, pp. 1022–1036 (9/69).

Karaki, "Surface Polishing Method", Abstract.

Hartnagel et al., *J. of Materials Science,* "A Contribution to Etch Polishing of GaAs", vol. 8, pp. 1061–1063 (4/10/73).

*Primary Examiner*—David L. Lacey

*Assistant Examiner*—Andrew J. Anderson

[57] ABSTRACT

A device for hydroplane polishing an exposed face of a sample includes a sample support having freedom of movement in a direction perpendicular to the exposed face; a polishing member having a surface opposite the exposed face; and a polishing fluid source for directing polishing fluid to a limited zone in the vicinity of the exposed face at sufficient pressure to cause the exposed face to hydroplane relative to the surface. Also, a device for rotating a sample relative to a surface for polishing a face of the sample using fluid in the space between the sample face and the surface includes a sample support held in a housing by an air bearing, and a source of air flow for rotating the support. Also, a device for hydroplane polishing includes a positive drive to rotate the sample support. Also, a device for polishing an exposed face of a sample includes a positive drive to rotate the sample and a positive drive to rotate the polishing member. Also, a device for hydroplane polishing includes a positive drive to rotate the polishing member, the sample also rotating. Also, a device for hydroplane polishing includes a polishing member that rotates around an axis and a mechanism for causing non-epicyclic motion of the exposed face relative to the axis.

15 Claims, 2 Drawing Sheets

HYDROPLANE POLISHING DEVICE AND METHOD

BACKGROUND OF THE INVENTION

The invention relates to polishing devices, e.g., for producing flat surfaces on wafers of semiconductor materials.

Integrated circuits often are formed on a flat surface of a wafer made of a semiconductor material such as gallium arsenide or indium phosphide. Calawa et al., U.S. Pat. No. 4,323,422, describes a polishing device for producing a flat, damage free surface on such wafers. The device has a polishing wheel, a sample mounting block carrying a plurality of wafers and positioned so that the surface of the wafer is adjacent to a portion of the wheel, and a spout for supplying polishing fluid to the center of the wheel. As the wheel rotates, the fluid is spread across the surface of the wheel by centrifugal force. The rapidly moving fluid lifts the wafers such that the wafers and the polishing wheel do not contact each other, i.e., the samples hydroplane on the fluid. The fluid forces on the samples cause the holder to rotate.

It has been proposed prior to my invention that a semiconductor wafer can be made to hydroplane by introducing a polishing fluid under pressure through openings in the polishing wheel. It also has been proposed that this approach be implemented by using a stationary polishing wheel having a band of holes through which fluid is supplied by means of an annular recess located on the underside of the wheel. The proposed device further has two sample holders—each suitable for supporting one wafer—connected by an arm that moves the holders over the band; the holders are supported in the arm by air bearings.

SUMMARY OF THE INVENTION

In general, the invention provides, in one aspect, an improved device for hydroplane polishing an exposed face of a sample. The device includes a support for the sample, the support having freedom of movement in a direction perpendicular to the exposed face; a polishing member having a surface opposite the exposed face; and a polishing fluid source for directing polishing fluid to a limited zone in the vicinity of the exposed face at sufficient pressure to cause the exposed face to hydroplane relative to the surface during polishing.

In some preferred embodiments, the surface has a plurality of openings through which the polishing fluid flows to the limited zone. In other preferred embodiments, the polishing member is a wheel capable of rotation around an axis perpendicular to the surface, and the device further includes a positive drive to rotate the wheel.

The invention features, in another aspect, a device for rotating a sample relative to a surface for polishing a face of the sample using fluid in the space between the sample face and the surface; the device includes a support for the sample, the support being held in a housing by an air bearing, and a source of air flow for rotating the support in the housing.

In some preferred embodiments, the support includes an air turbine, and the air flow contacts the air turbine to rotate the support in the housing.

The invention features, in another aspect, a device for hydroplane polishing an exposed face of a sample, the device including a support for the sample, the support having freedom of movement in a direction perpendicular to the exposed face and being capable of rotation around an axis perpendicular to the exposed face; a polishing member having a surface opposite the exposed face; a polishing fluid source for directing polishing fluid to the exposed face at sufficient pressure to cause the exposed face to hydroplane relative to surface during polishing; and a positive drive to rotate the support around the axis to provide shear forces on the exposed face relative to the fluid.

The invention features, in another aspect, a device for polishing an exposed face of a sample, the device including a support for the sample, wherein the support allows the sample to have freedom of rotation around a first axis perpendicular to the exposed face; a polishing member having a surface opposite the exposed face, the polishing member being capable of motion relative to the first axis; a polishing fluid source for directing polishing fluid to the surface of the polishing member; a first positive drive to rotate the sample around the first axis to produce polishing forces on the exposed face; and a second positive drive to move the polishing member relative to the axis to produce polishing forces on the exposed face.

In some preferred embodiments, the polishing member is capable of rotation around a second axis parallel to and spaced apart from the first axis, and the second positive drive rotates the polishing member around the second axis.

The invention features, in another aspect, a device for hydroplane polishing an exposed face of a sample, the device including a support for the sample, the support having freedom of movement in a direction perpendicular to the exposed face wherein the support allows the sample to have freedom of rotation around a first axis perpendicular to the exposed face; a polishing member having a surface opposite the exposed face, the polishing member being capable of rotating around a second axis parallel to and spaced apart from the first axis; a polishing fluid source for directing polishing fluid to the exposed face at sufficient pressure to cause the exposed face to hydroplane relative to the surface during polishing; and a positive drive to rotate the polishing member around the second axis to provide shear forces on the exposed face relative to the fluid, the sample being rotated around the first axis to provide shear forces on the exposed face relative to the fluid.

In some preferred embodiments, the shear forces produced by the rotation of the polishing member cause the rotation of the sample around the first axis.

The invention features, in another aspect, a device for hydroplane polishing an exposed face of a sample, the device including a support for the sample, the support having freedom of movement in a direction perpendicular to the exposed face; a polishing member having a surface opposite the exposed face, the polishing member being capable of rotation around an axis perpendicular to the exposed face; a polishing fluid source for directing polishing fluid to the exposed face at sufficient pressure to cause the exposed face to hydroplane relative to the surface during polishing; a positive drive to rotate the polishing member around the axis to provide shear forces on the exposed face relative to the fluid: and a mechanism for causing non-epicyclic motion of the face relative to the axis to produce shear forces on the exposed face relative to said fluid.

In some preferred embodiments, the mechanism is a carriage that moves the support to provide linear radial motion of the exposed face relative to the axis.

The invention also features methods of polishing an exposed face of a sample. Preferably, the sample is a semiconductor material such as gallium arsenide.

During hydroplane polishing, the sample being polished floats (i.e., is suspended) on the polishing fluid at a sufficient distance (at least about 0.001 inch) above the surface of the polishing wheel to avoid the mechanical damage that close contact between the wheel and the sample can cause. Hydroplane polishing results in wafers that are flat and undamaged, and, accordingly, are ready for use in semiconductor device fabrication without further polishing.

The polishing devices of the invention have a good polishing rate, and large semiconductor wafers (i.e., those over about 3 inches in diameter) are efficiently polished by the device. By restricting the polishing fluid flow to a limited zone in the vicinity of the exposed face, e.g., within the circumference of the exposed face, a minimum volume of fluid is used during polishing, and sufficient pressure can be maintained for hydroplaning to occur.

The positive air drive system of the invention provides an inexpensive and simple mechanism for obtaining a high rotation rate of the sample being polished. Moreover, the air bearing used in conjunction with the air drive system is resistant to jamming.

Other features and advantages of the invention will be apparent from the following description of the preferred embodiment thereof, and from the claims.

DESCRIPTION OF THE PREFERRED EMBODIMENT

The drawings will first briefly be described.

Drawings

STRUCTURE

Figure 1:
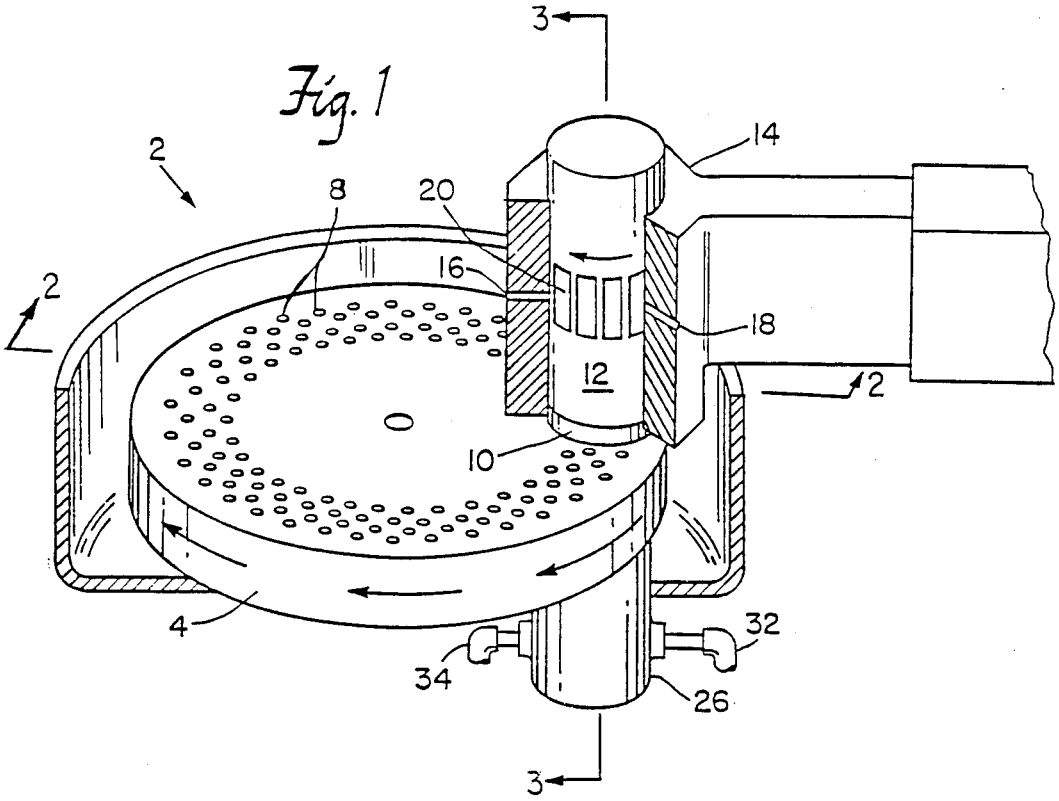
FIG. 1 is a perspective view of portion of a polishing device, partially in section.
Figure 2:
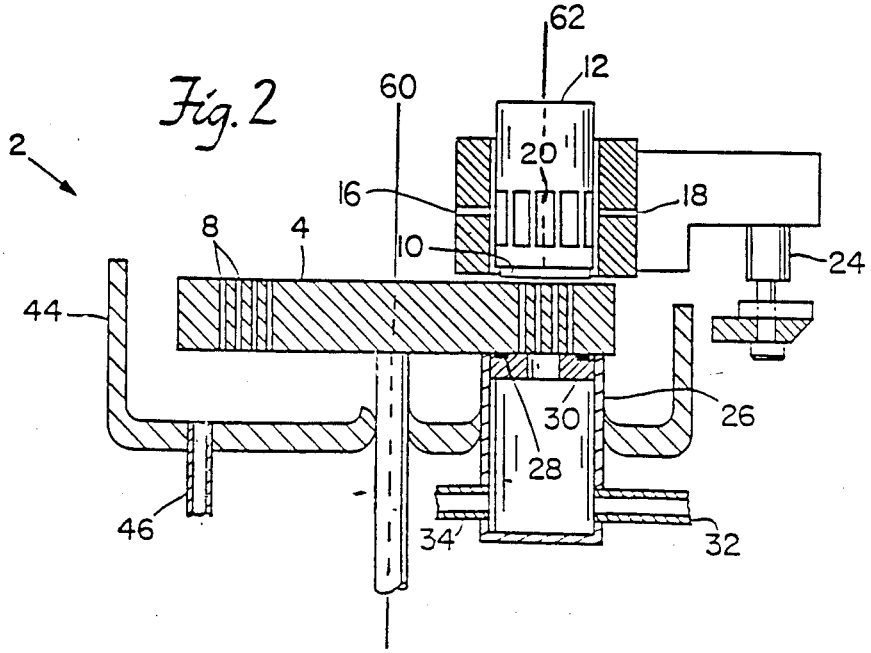
FIG. 2 is a sectional view at 2—2 of FIG. 1, including additional portions of the device.
Figure 3:
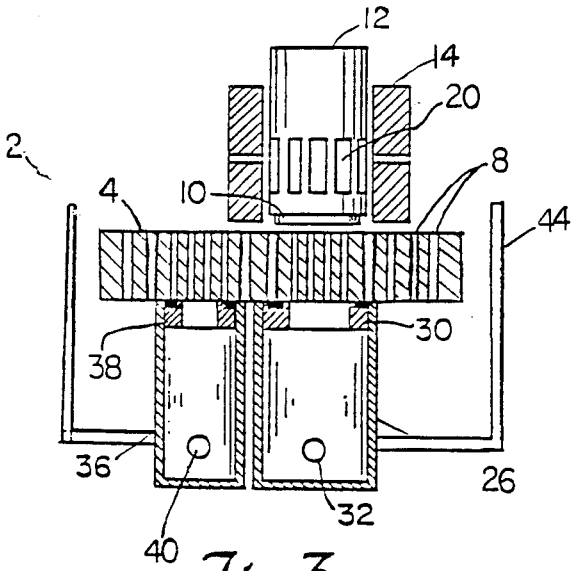
FIG. 3 is a sectional view at 3—3 of FIG. 1.

Referring to FIGS. 1–3, a hydroplane polishing device 2 has a polishing wheel 4 connected to a variable speed drive system (not shown) for rotating the wheel around axis 60. Wheel 4 is 8.5 inches in diameter and has a 1.5 inch wide band of 0.25 inch diameter holes 8. The outer boundry of the band of holes is located 1 inch from the edge of the wheel. The holes are arranged in a irregular spacing fashion, with about 0.12 inches separating each hole from its closest neighbor.

A 3.0 inch diameter gallium arsenide wafer 10 which is to be polished, is attached to the bottom of sample holder 12. The sample holder, which weighs 3 pounds, is rotatably mounted in arm 14 by an air bearing; the sample holder can rotate freely around axis 62, and also has free vertical movement. The arm has four air inlets 16 equally spaced in around the perimeter at the same distance from the wheel. The air inlets are connected by hoses to an air supply (not shown) Four air exits 18 are equally spaced in the same manner. Located on the sample holder at the same height as the air inlets are turbine grooves 20.

The arm 14 is connected to a cam (not shown) that is capable of moving the arm radially (with respect to axis 60) over the polishing wheel. The arm is also connected to a hydraulic support 24 that can raise and lower the arm.

A 3 inch diameter pipe 26 is centered beneath the band of holes opposite the wafer 10, and is sealed to the underside of the polishing wheel by a flat TEFLON seal 28, which is loose enough to allow free rotation of the wheel but tight enough so that a polishing fluid flowing through the pipe at low pressure (e.g., 0.5 psi) will not leak. A flow restrictor 30 is located at the upper end of the pipe. The flow restrictor has an oval shaped opening that is $1\frac{1}{2}$ inches wide (radial direction) and $2\frac{1}{2}$ inches long. The pipe has a polishing fluid inlet 32, connected to a fluid supply (not shown), and a rinsing fluid inlet 34, which is connected to a rinsing fluid supply (not shown).

A 2 inch diameter pipe 36 is centered beneath the band of holes adjacent to the pipe 26. The pipe 36 is also sealed to the underside of the polishing wheel, and has a flow restrictor 38 that is $1\frac{1}{2}$ inches wide (radial direction) and 0.5 inches in length. The pipe 36 has a polishing fluid inlet 40 and a rinsing fluid inlet (not shown).

The polishing wheel is enclosed by a container 4, which has a drain 46.

Operation

The polishing device operates as follows.

The sample holder 12 is raised above the polishing wheel, and the wafer 10 is affixed to the bottom of the sample holder using a suitable adhesive material, e.g., a mounting wax. The arm is adjusted so that the sample holder is centered over the band of holes.

A polishing fluid, e.g., the methanol-ethylene glycol-bromine solution described in Calawa et al., U.S. Pat. No. 4,323,422, which is hereby incorporated by reference herein, is pumped into the pipe 26 through the inlet 32. The liquid flows through the holes and onto the surface of the wheel at a low pressure, e.g., 0.5 psi. Liquid is also pumped into the pipe 36 through a polishing fluid inlet 40, at very low pressure, e.g., 0.5 psi. The sample holder is lowered, and the wafer contacts and hydroplanes on the fluid, which supports the shaft at a slight height, e.g., 0.005 inch, above the surface of the wheel.

Simultaneous with the lowering of the sample holder, the drive system is activated to rotate the wheel around an axis 60 (which is perpendicular to the wafer surface being polished. i.e., the exposed face) at a suitable polishing rate, e.g., at 100–2000 rpm; and air is introduced through the air inlets to contact the turbine grooves causing the sample holder and the sample to rotate around an axis 62 (which is parallel to and spaced apart from axis 60) at a suitable polishing rate, e.g., 4000 rpm. The cam also is activated to move the wafer radially (with respect to axis 60) over the band of holes. In general, the radial movement is limited so that the holes through which the fluid flows are always covered by the wafer; in the device represented in FIGS. 1–3, which is polishing a 3.0 inch wafer that starts out centered over the band of holes, the cam should move the arm no more than about $\frac{3}{4}$ inch in either radial direction.

As the polishing wheel rotates, a portion of the band of holes first receives fluid from the pipe 36 The flow from pipe 36 acts as a prime to ensure that, by the time the holes that are to receive fluid from pipe 26 are beneath the wafer, there is no air in the holes that could be forced into contact with the wafer. The portion of the band of holes then passes beneath the wafer; the fluid flows out from the pipe 26 and the pressure of the fluid on the wafer maintains the wafer at the slight height above the wheel.

If enough holes through which the fluid is flowing are left uncovered, the fluid tends to flow through the path of least resistance, i.e., the uncovered holes, and the fluid pressure underneath the wafer may not be sufficient to counteract the capillary action that tends to pull the wafer towards the surface of the wheel. By limiting the flow to the area under the wafer, a steady supply of fluid underneath the wafer is maintained sufficient to support the wafer (and the sample holder) above the surface of the polishing wheel, and the sample hydroplanes on the fluid. The wafer thus never contacts the surface of the wheel and, accordingly, the mechanical damage that such contact can cause is avoided.

The polishing fluid chemically etches the surface of the wafer. The rotation of the wheel around axis 60 and the sample holder (and thus the sample) around axis 62; the radial motion provided by the arm; and the fluid pressure produce fluid shear forces on the surface of the wafer that cause etching by-products to be washed off the surface and immediately replaced by a steady supply of fresh fluid. The rotations, radial motion, and flow pressure also assist in distributing fresh fluid evenly over the surface of the wafer, thus producing a flat surface. In addition, the radial motion of the arm (which provides a non-epicyclic motion on the wafer surface relative to the axis 60) and the rotation of the polishing wheel aid in producing a flat polished surface by maintaining uniform shear forces over the entire surface of the wafer.

The device provides for control of the rate of polishing through adjustment of several parameters. In general, the rate of polishing increases as the shear forces on the surface of the wafer increase. Accordingly the polishing rate can be increased by increasing the rate of rotation of either the sample holder or the polishing wheel; by increasing the polishing fluid flow rate; or by increasing the rate at which the arm is moved radially over the holes. When the rotation rate of the polishing wheel is increased, the capillary forces pulling the sample holder toward the wheel surface increase, and the flow rate of the fluid should also be increased to keep the sample holder floating.

Because the fluid flow is limited to a zone beneath the wafer, the device uses a minimum volume of fluid. The fluid that is used drains back through the holes, or off the perimeter of the wheel (by centrifugal force), and into the container 44. The fluid exits the container through the drain 46, carrying with it the etchings from the wafer, and can be recycled for further use following filtration.

The positive air drive system of the arm and sample holder maintains a high rotation rate for the sample holder. Moreover, in addition to driving the air turbine, the air pressurizes the space between the sample holder and the arm. The sample holder accordingly does not rock in the arm, and a flat wafer surface (exposed face) consistently is presented to the surface of polishing wheel.

After a wafer surface has been polished for a sufficient period of time, a rinse fluid is pumped into the pipes through the rinse fluid inlets, and the polishing fluid supply is shut off. The rinse fluid washes the remaining polishing fluid out of the pipe and off the surface of the wafer. Because there is a limited volume of polishing fluid on the wheel, only a limited volume of rinsing fluid is utilized.

Other Embodiments

Figure 4:
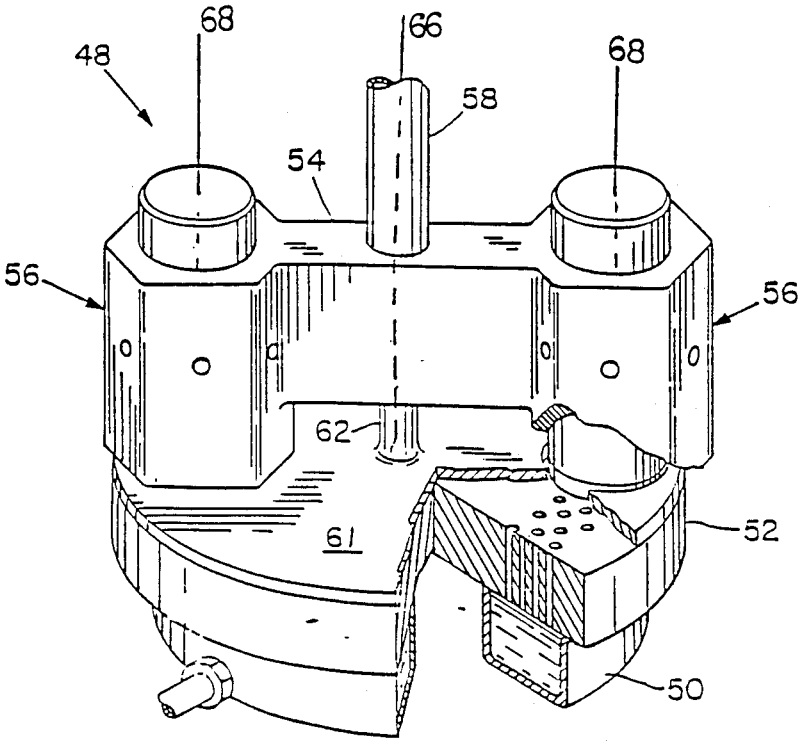
FIG. 4 is a perspective view of a portion of a polishing device.

Other embodiments are within the following claims. For example, referring to FIG. 4, in a polishing device 48 a polishing fluid supply pipe 50 provides polishing fluid to all of the holes on a polishing wheel 52. An arm 54 extends radially across the polishing wheel. Opposing ends 56 of the arm contain sample holders in the same air bearing-positive drive arrangement as in the preferred device. A drive arm 58 extends upwards from the center of arm 54; the drive arm is connected to a variable speed motor. A baffle 61 extends across the wheel from a rod 62 connected to the center of the arm 54. The baffle covers all the holes except those underneath the sample holder.

To operate the polisher, wafers are affixed to the sample holder, a polishing fluid is pumped into the pipe 50, and the sample holders are lowered. The wafers float as in the preferred device. The motor is activated to rotate arm 54 around axis 66; the positive air drives are also activated to rotate the sample holders around axes 68. The baffle, which turns with the sample holder, restricts the fluid pressure to beneath the wafer, thus providing sufficient lift to cause the wafers to hydroplane above the surface of the polishing wheel.

The sample holder does not need to have a positive drive system for the holder to rotate during polishing. Where either the wheel 52 or the arm 54 rotates around the axis 66, the force of the polishing fluid on the sample is greatest on the outer part of the sample (that part of the sample that at a given moment is closest to the perimeter of the wheel), causing the samples, and holders, to rotate.

I claim:

1. A device for hydroplane polishing exposed face of a sample, comprising a support for said sample, said support having freedom of movement in a direction perpendicular to said exposed face;

a polishing member having a surface opposite said exposed face; and a polishing fluid source which directs polishing fluid to a limited zone within the circumference of said exposed face at sufficient pressure to cause said exposed face to hydroplane relative to said surface during polishing, wherein said polishing fluid flows from said fluid source to said limited zone from a location opposite to said exposed face.

2. The device of claim 1, wherein said surface has a plurality of openings through which said polishing fluid flows to said limited zone.

3. The device of claim 2, wherein said flow is limited by a baffle extending across said surface of said polishing member to block the said openings that are not adjacent to said exposed face of said sample.

4. The device of claim 2, said device further comprising a fluid supplier that provides polishing fluid only to at least one of said openings adjacent to said exposed face.

5. The device of claim 1, wherein said polishing member is capable of rotation around an axis perpendicular to said surface to provide shear forces on said exposed face relative to said fluid, said device further comprising a positive drive to rotate said polishing member around said axis.

6. The device of claim 1, wherein said support is capable of rotation around an axis perpendicular to said exposed face, said support comprising a positive drive to rotate said support around said axis to provide shear forces on said exposed face relative to said fluid.

7. The device of claim 7, wherein said positive drive comprises an air turbine.

8. The device of claim 1, wherein said device further comprises an arm, said support being rotatably mounted by an air bearing on said arm to allow said support to rotate around an axis perpendicular to said exposed face.

9. A method for hydroplane polishing an exposed face of a sample, comprising supporting said sample for freedom of movement in a direction perpendicular to said exposed face;

providing a polishing member having a surface opposite said exposed face; and directing polishing fluid to a limited zone within the circumference of said exposed face at sufficient pressure to cause said exposed face to hydroplane relative to said surface during polishing.

10. The method of claim 9, wherein said surface has a plurality of openings through which said polishing fluid flows to said limited zone.

11. The method of claim 9, wherein said method further comprises rotating said polishing member around an axis perpendicular to said surface to provide shear forces on said exposed face relative to said fluid.

12. The method of claim 9, wherein said method further comprising rotating said sample around an axis perpendicular to said exposed face to provide shear forces on said exposed face relative to said fluid.

13. The method of claim 9, wherein said sample comprises a semiconductor material.

14. The method of claim 13, wherein said semiconductor material is gallium arsenide.

15. A device for hydroplane polishing an exposed face of a sample comprising a semiconductor material, comprising a support for said sample, said support having freedom of movement in a direction perpendicular to said exposed face and being capable of rotating around a first axis perpendicular to said exposed face;

a polishing wheel having a surface opposite said exposed face, said polishing wheel being capable of rotation around a second axis parallel to and apart from said first axis;

a polishing fluid source which directs polishing fluid from a direction opposite to said exposed face to a limited zone within the circumference of said exposed face at sufficient pressure to cause said exposed face to hydroplane relative to said surface during polishing;

a positive air drive to rotate said support around said first axis to produce shear forces on said exposed face relative to said fluid; and a positive drive to rotate said wheel around said second axis to produce shear forces on said exposed face relative to said fluid.

* * * * *